US006241108B1

(12) United States Patent
Nakatani et al.

(10) Patent No.: US 6,241,108 B1
(45) Date of Patent: Jun. 5, 2001

(54) MODULAR SHELVING UNIT

(75) Inventors: Kazuo Nakatani; Koji Ueda, both of Osaka (JP)

(73) Assignee: Yamazen Corp., Osaka (JP)

( * ) Notice: Subject to any disclaimer, the term of this patent is extended or adjusted under 35 U.S.C. 154(b) by 0 days.

(21) Appl. No.: 09/430,963

(22) Filed: Nov. 1, 1999

(30) Foreign Application Priority Data

Mar. 11, 1999 (JP) ..... 11-064389

(51) Int. Cl.[7] ..... A47B 47/00
(52) U.S. Cl. ..... 211/187; 108/108; 108/147.15
(58) Field of Search ..... 211/187, 181.1; 108/186, 181, 147.11, 147.12, 147.13, 157.13, 147.15; 285/383, 370, 371, 397, 398

(56) References Cited

U.S. PATENT DOCUMENTS 5,676,263 * 10/1997 Chang ..... 211/187
5,895,079 * 4/1999 Carstensen et al. ..... 285/370 X

* cited by examiner

*Primary Examiner*—Daniel P. Stodola
*Assistant Examiner*—Erica B. Harris
(74) *Attorney, Agent, or Firm*—Jordan and Hamburg LLP

(57) ABSTRACT

A modular shelving unit includes at least three upright posts spaced apart from each other for supporting a shelf between them. At least one of the at least three posts includes at least two tubular members and at least one interconnecting member for detachably interconnecting adjacent, tubular members via attaching means. The at least two tubular members each have opposite edges and an inner circumferential wall defining annular inclined surfaces. The annular inclined surfaces are radially and outwardly inclined, as they advance to adjacent edges of the opposite edges. The interconnecting member has an outer circumferential wall with opposite end portions and a flange-like stopper radially and outwardly projecting from the outer circumferential wall. The adjacent tubular members are interconnected to the interconnecting member via the attaching means with mutually facing edges of the adjacent tubular members abutting each other. The annular inclined surfaces of the adjacent tubular members together form a positioning groove continuously extending along The abutting edges of the adjacent tubular members, and the flange-like stopper is fitted into the positioning groove with the flange-like stopper resting on the inclined surfaces of the positioning groove.

10 Claims, 19 Drawing Sheets

MODULAR SHELVING UNIT

BACKGROUND OF THE INVENTION

1. Field of the Invention

The present invention relates to a modular shelving unit, and particularly a modular shelving unit including posts each formed by interconnecting a plurality of tubular members together.

2. Discussion of the Background

FIGS. 14 and 15 illustrate the modular shelving unit of a well-known type, which includes four upright posts 51, spacers 53 respectively attached on the posts 51, and a shelf 52 detachably supportable by the posts 51 via sockets 54 provided at respective corners of the shelf adapted for respectively fitting around the spacers 53 on the posts 51.

The posts 51 each include a plurality of tubular members 55 interconnected together via interconnecting members 56 each having outwardly threaded portions 57 at its upper and lower end portions. The inner circumferential wall of each tubular member 55 forms an inwardly threaded portion. The interconnection of adjacent tubular members 55 is accomplished by threaded engagement between the outwardly threaded portions 57 of the interconnecting member 56 and corresponding inwardly threaded portions of the tubular members 55. The interconnecting member 56 is provided on the outer circumferential wall between the opposite end portions thereof with a flange-like stopper 58 which is interposed between the abutting edges of the tubular members 55 and is exposed to the outside when the adjacent tubular members are interconnected together.

The above prior art arrangement has a drawback that a relatively heavy load caused by an object placed on the shelf 52 concentrates mainly into the stoppers 58, causing an excessive load over the stoppers 58. This may result in a slight deformation of the posts 51 around the interconnecting members 56.

For the modular shelving unit with posts 51, each of which forms axially spaced annular grooves 59 in the outer circumferential surface thereof, the spacer 53 is adapted to be retained in a selected annular groove 59 to adjust the height of the shelf 52. The stopper 58 has opposite surfaces and a diameter smaller than the outer diameter of the tubular members 55, wherein the abutting edges of the adjacent tubular members 55 respectively abut against the opposite surfaces of the stopper 58 so as to form an annular groove 59 in cooperation with the surfaces of the abutting edges of the tubular members 55, the width of which depends on the space between the adjacent tubular members 55 (see FIG. 15). The load tends to be applied over a particular region, and more specifically the abutting regions between the stopper 58 of a smaller diameter and the mutually facing edges of the adjacent tubular members 55. Consequently, the edges of the tubular members 55 or other adjacent portions may be chipped off or deformed.

In consideration of the above problems, a modular shelving unit having a different interconnection arrangement has been proposed, as illustrated in FIG. 16. This arrangement omits the stopper 58 of the interconnecting member 56 to allow the mutually facing edges of the adjacent tubular members 55 to directly contact each other. With this direct abutment of the tub ular members 55, the load applied to one of the tubular members 55 is transferable to the adjacent tubular member 55 for dispersion of the load.

However, the modular shelving unit of this arrangement also has a drawback that, since the interconnection between the tubular members 55 is accomplished by a threaded engagement only, improper positioning of the interconnecting member with regard to the tubular members 55 may occur during screwing operation, which results in unstable interconnection of the tubular members 55, as illustrated in FIG. 17. Such improper positioning or unstable connection can not be corrected even by the abutment between the tubular members 55 and the stopper. This causes the tubular members to slightly tilt sidewards from the axis of each post after they are interconnected together.

The modular shelving unit of the above arrangement in accordance with another prior art design, as shown in FIGS. 18, 19*a*, and 19*b* further includes the posts 51, each of which has an uppermost tubular member 55, and a cap 61 forced into an upper end 51*a* of the upper most tubular member 55 or of each post. Each post 51 of the modular shelving unit also has a lowermost tubular member 55, and an adjustable foot 62 in the form of a connector which is forced into a lower end 51*b* of the lowermost tubular member 55 or of each post. A caster 63 is optionally mounted to the connector 62 of each post 51.

To form each post 51 according to the above arrangement, at least two tubular members 55, specifically the uppermost and lowermost tubular members 55 are required, since the opposite ends of each post 51 need to be covered by the cap 61 and the connector 62. That is, for the modular shelving unit of a shorter length accommodating only one tubular member 55 for each post 51, and therefore using the uppermost tubular member 55 or the lowermost tubular member 55 for each post, the upper most tubular member 55 without the adjustable foot or the caster 63 may damage a floor with the lower edge 51*b*, or the post may be damaged by the floor surface. When only the lowermost tubular member 51 is used for each post, a user's cloth, etc., may be accidentally caught on or damaged by the upper edge 51*a* of the tubular member 51, and an appearance of the unit may be deteriorated. Thus, the modular shelving unit of such a conventional type may lower the flexibility in assembling the unit according to various conditions.

Therefore, an object of the invention is to provide a modular shelving unit that is capable of avoiding the concentration of the load into an interconnecting member interposed between the adjacent tubular members, and the tilting of the post in assembled state, as well as increasing the unit strength to such a degree as to be tolerable against a possible load.

Another object of the invention is to provide a modular shelving unit that is capable of being assembled by flexibly combining the tubular members or selecting a proper number of the tubular members for each post by a user without the limitation of the attaching points for the cap and the adjustable foot.

SUMMARY OF THE INVENTION

According to the present invention, there is provided a modular shelving unit including at least three upright posts spaced apart from each other, at least one shelf supported between the at least three upright posts, spacers respectively attached on the at least three posts, and sockets provided on the at least one shelf for being respectively fitted around the spacers in such a manner as to support the at least one shelf between the at least three posts. At least one post of the at least three posts includes at least two tubular members and at least one interconnecting member for detachably interconnecting adjacent tubular members of the at least two tubular members together via attaching means. The at least two tubular members each have opposite edges and an inner circumferential wall defining annular inclined surfaces. The annular inclined surfaces are radially and outwardly inclined, as they advance to adjacent edges of the opposite edges. The at least one interconnecting member has an outer circumferential wall with opposite end portions and a flange-like stopper radially and outwardly projecting from the outer circumferential wall. The adjacent tubular members of the at least two tubular members are interconnected to the at least one interconnecting member via the attaching means with mutually facing edges of the adjacent tubular members abutting each other. The annular inclined surfaces of the adjacent tubular members together form a positioning groove continuously extending along the abutting edges of the adjacent tubular members, and the flange-like stopper is fitted into the positioning groove with the flange-like stopper resting on the inclined surfaces of the positioning groove.

According to the modular shelving unit of the above arrangement, the contacting engagement between the positioning groove and the stopper can avoid the improper positioning of the interconnecting member with regard to the tubular members, thereby achieving stable interconnection of the tubular members. Further, the stopper fitted into the positional groove does not prevent the adjacent tubular members from directly abutting against each other via their abutting edges, so that the load caused by an object placed on the shelf can be transferred to the adjacent tubular members, resulting in the dispersion of the load which tends to be applied over the interconnecting member.

The attaching means of the modular shelving unit of the above arrangement preferably includes an inwardly threaded portion formed on the inner circumferential wall of each of the at least two tubular members and outwardly threaded portions respectively formed on the opposite end portions of the at least one interconnecting member for being respectively screwed into the inwardly threaded portions of the adjacent tubular members, and the flange-like stopper is formed between the outwardly threaded portions of the at least one interconnecting member. On the other hand, the at least one interconnecting member preferably forms annular recesses in the outer circumferential wall thereof between the flange-like stopper and the outwardly threaded portions. According to this arrangement, a possible burr generated by the friction between the inwardly threaded portions formed in the inner circumferential walls of the adjacent tubular members and the outwardly threaded portions of the interconnecting member can be escaped into the annular recesses, allowing the interconnecting member to be smoothly screwed into the adjacent tubular members.

The modular shelving unit preferably includes the at least three posts each being provided on the outer circumferential wall with axially spaced annular grooves. The spacers each include a plurality of parts respectively having inner circumferential walls respectively defining protrusions which together form an annular protrusion for being fitted into a corresponding one of the axially spaced annular grooves of each of the at least three posts when the plurality of parts are interconnected together, thereby allowing the spacers to be respectively and detachably attached to the at least three posts. The at least two tubular members each have an outer circumferential wall defining annular inclined surfaces radially and inwardly inclined as they advance to adjacent edges of the opposite edges of each of the at least two tubular member, in which the annular inclined surfaces of adjacent tubular members of the at least two tubular members together form an assembled annular groove continuously extending along the abutting edges of the adjacent tubular members so as to receive the annular protrusion of a corresponding one of the spacers.

According to the above arrangement, the spacers can also be retained on the posts via the assembled annular grooves formed at the interconnecting portion of the adjacent tubular members, allowing the shelf to be placed at a height corresponding to the position where the assembled annular grooves are formed. This enables the modular shelving unit to be assembled in various formations.

The modular shelving unit may further include caps and adjustable feet which respectively have outwardly threaded portions provided on the outer circumferential walls thereof for being respectively screwed into the inwardly threaded portions of the tubular members, so that the at least three posts can be provided with the caps and the adjustable feet.

According to another aspect of the invention, there is provided an interconnecting member for interconnecting two tubular members together with mutually facing edges of the adjacent tubular members abutting each other. Each interconnecting member includes a cylindrical body having a lengthwise axis and an outer circumferential wall with opposite end portions respectively forming outwardly threaded portions for being respectively screwed into inwardly threaded portions formed in inner circumferential walls of the tubular members. A flange-like stopper radially and outwardly projects from the outer circumferential wall of the cylindrical body between the outwardly threaded portions, in which the flange-like stopper is fitted into an annular positional groove formed along the abutting edges of the adjacent tubular members when the tubular members have been interconnected together with the mutually facing edges thereof abutting each other. This interconnecting member has been designed to be one component forming the modular shelving unit of the above arrangement.

To achieve the latter object of the present invention, there is provided at least three upright posts spaced apart from each other, at least one shelf supported between the plurality of upright posts, caps respectively attached on upper end portions of the at least three upright posts, and adjustable feet respectively attached on lower end portions of the at least three upright posts. At least one post of the at least three upright posts includes at least two tubular members and at least one interconnecting member for interconnecting adjacent tubular members of the at least two tubular members together. The at least two tubular members each have opposite end portions, to which each of the caps and each of the adjustable feet can be respectively and detachably-attached.

According to the modular shelving unit of the above arrangement, for example, when the user desires to form each post of the posts by using one of the tubular members for the modular shelving unit having a relatively lower formation, the post can be equipped at its upper and lower end portions with the cap and the adjustable foot, respectively. Or, when the user desires to form each post by using three tubular members for the modular shelving unit having a relatively higher formation, the post can be formed by interconnecting the tubular members together via the interconnecting members and attaching the cap and the adjustable foot respectively to the upper and lower end portions of the post.

Thus, the user can select a suitable number of the tubular members to form each post of a predetermined length with the cap and the adjustable foot respectively attached to the upper and lower ends of each post for the modular shelving unit having a formation of various sizes or heights.

The modular shelving unit of the above arrangement preferably includes the opposite end portions of the at least two tubular members respectively forming inwardly threaded portions, and the interconnecting member, the caps and the adjustable feet respectively having outwardly threaded portions for being respectively screwed into the inwardly threaded portions of the at least two tubular members. This threaded engagement can achieve ease of operation and increase the unit strength of the shelving unit. Particularly, the posts of the unit can easily be leveled, since the attachment of the adjustable foot can be accomplished only by the screwing motion.

BRIEF DESCRIPTION OF THE DRAWINGS

The above, and other objects, features and advantages of the present invention will become apparent from the detailed description thereof in conjunction with the accompanying drawings wherein.

FIG. 15(*b*) is an enlarged view of the tubular members with a partly cross section in an attached state with the conventional interconnection mechanism.

FIG. 19(*b*) is a cross section of a portion of the modular shelving unit defined by the circle B in FIG. 18.

DETAILED DESCRIPTION OF THE PREFERRED EMBODIMENT

Figure 1:
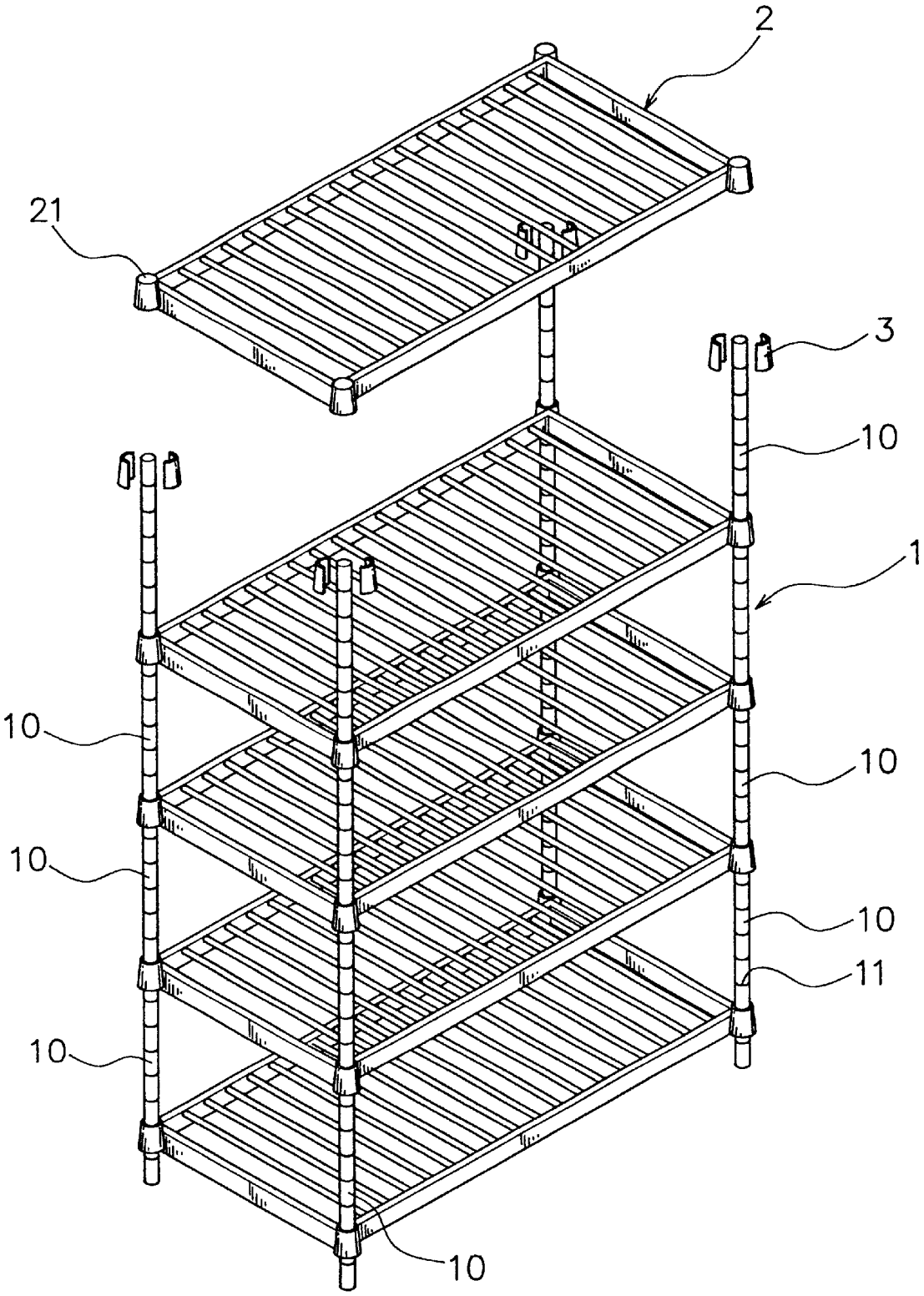
FIG. 1 is a perspective view of a modular shelving unit according to a first embodiment of the present invention.

An embodiment of the present invention will be hereinafter described with reference to the accompanying drawings. FIG. 1 is a perspective view of the modular shelving unit according to a first embodiment of the present invention, which includes four upright posts 1 spaced apart from each other, spacers 3 respectively attached on predetermined portions of the upright posts 1, and sockets 21 mounted on each of shelves 2, and detachably fitted around the spacers 3 so that the shelves 2 each are supported at a predetermined height among the posts 1.

Figure 2:
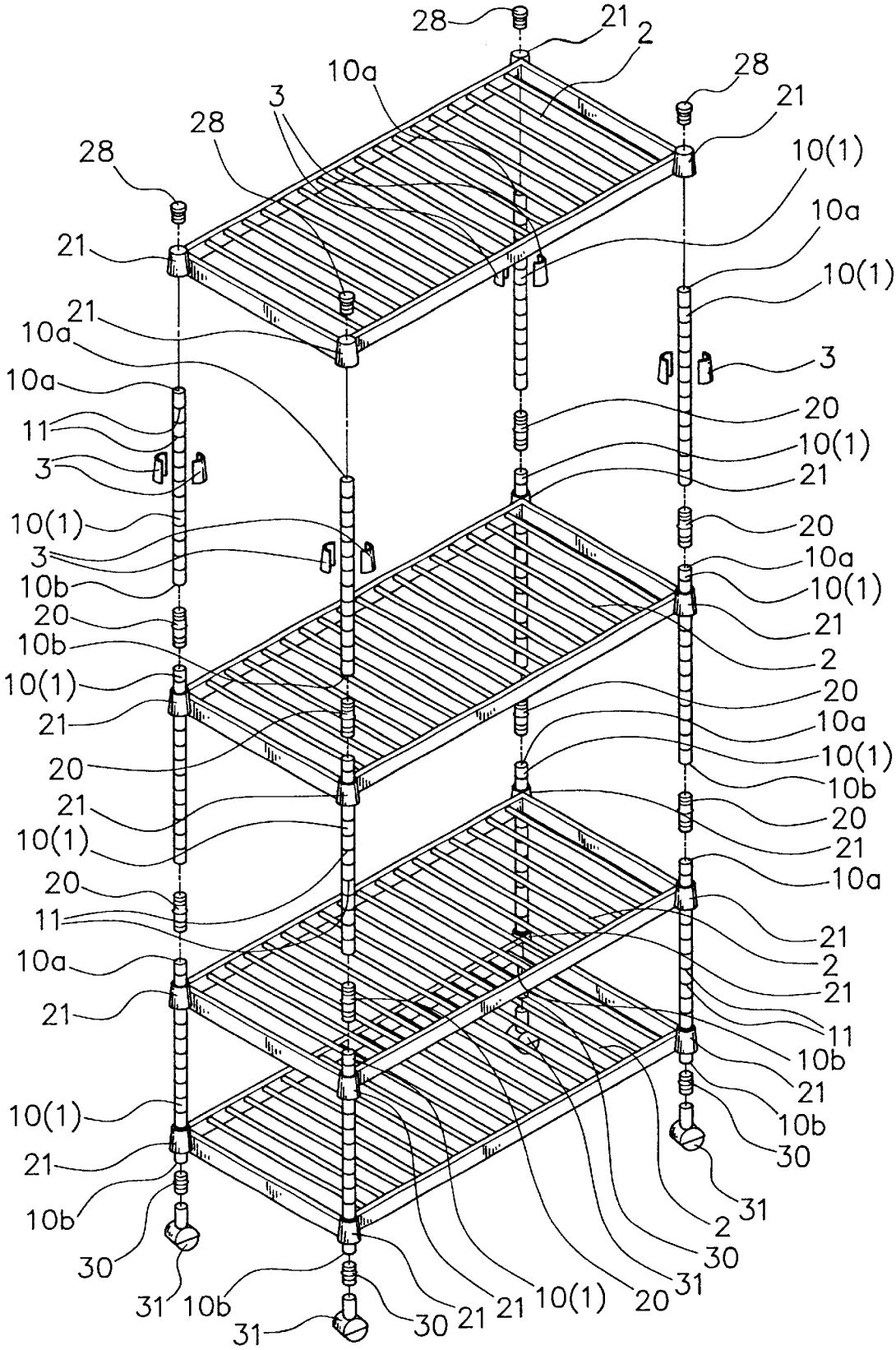
FIG. 2 is an exploded perspective view of the modular shelving unit of FIG. 1.

As illustrated in FIG. 2, the posts 1 each are formed by interconnection of a plurality of tubular members 10, each having a lengthwise axis, an outer circumferential wall forming therein a plurality of axially spaced apart annular grooves 11 each having a substantially semi-circular cross section.

Figure 3:
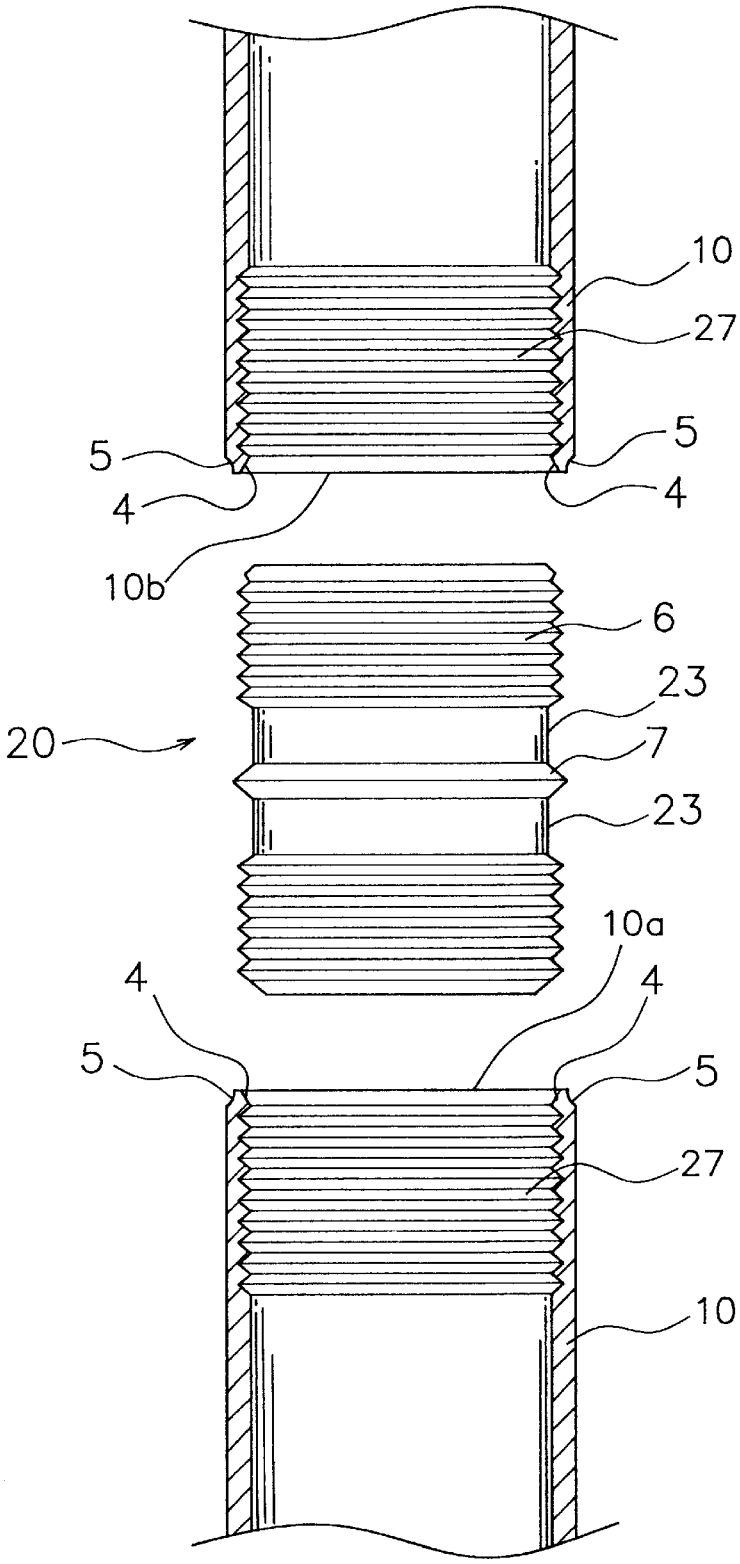
FIG. 3 is an enlarged and exploded view with a partially cross section of an essential portion of an interconnecting mechanism of tubular members used in the modular shelving unit of FIGS. 1 and 2.

As illustrated in FIG. 3, the tubular members 10 each have the opposite end portions 10*a*, 10*b* whose inner circumferential walls respectively form inwardly threaded portions 27 extending a predetermined length inwardly from the corresponding edges of the tubular members 10, and having a uniform shape or pitch. The opposite end portions 10*a*, 10*b* of each tubular member will be respectively referred to upper and lower end portions when they are referred as a part of each upright post 1.

The inner circumferential wall of each tubular member forms annular inclined surfaces radially and outwardly inclined to the opposite edges of the tubular member, and the outer circumferential wall of each tubular member forms annular inclined surfaces radially and inwardly inclined to the opposite edges of the tubular member. In this embodiment, the tubular members have a uniform length, although they may be varied in length.

Figure 4:
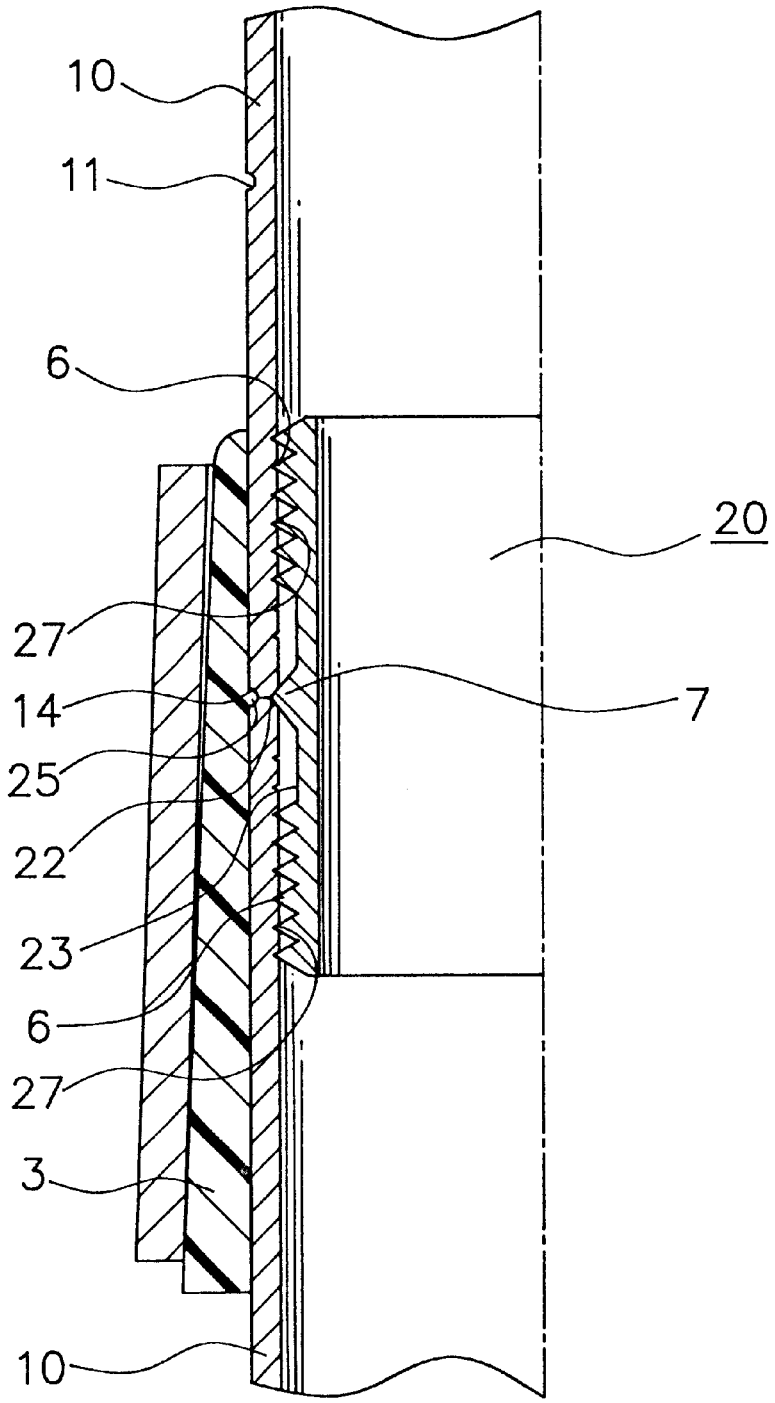
FIG. 4 is an enlarged cross section of an essential portion of the interconnecting mechanism of the tubular members used in the modular shelving unit of FIGS. 1 and 2.

As illustrated in FIG. 4, the abutting edges of adjacent tubular members to be interconnected form a positional groove 22 having a V-shaped cross section with the annular inclined surfaces formed in the inner circumferential walls and an assembled annular groove 14 (11) having a semi-circular cross section with the annular inclined surfaces formed in the outer circumferential walls.

Adjacent tubular members 10 are interconnected together by an interconnecting member 20 which has a cylindrical body having a lengthwise axis and an outer circumferential wall with opposite end portions respectively forming outwardly threaded portions 6, and which has a flange-like stopper 7 having a substantially triangular cross section formed between the outwardly threaded portions of the cylindrical body. Annular recesses 23 are formed in the entire surfaces of the outer circumferential wall of the cylindrical body of the interconnecting member between the stopper 7 and the outwardly threaded portions 6. The interconnection of the adjacent tubular members 10 is accomplished by the threaded engagement between the outwardly threaded portions of the interconnecting member 20 and the inwardly threaded portions 27 of the tubular members 10. The flange-like stopper 7 has the diameter set to be equal to the diameter of the bottom of the positioning groove 22, which is smaller than the outer diameter of each tubular member 10 but larger than the inner diameter thereof. The flange-like stopper 7 has such a size and shape as to be completely fitted inside of the positioning groove 22 in contacting engagement with the inclined surfaces 4 forming the positioning groove 22. Accordingly, the mutually facing edges of the tubular members interconnected together contact each other and form the positioning groove 22 along the abutting edges of the tubular members 10. The thus formed positioning groove 22 can accommodate the entire portion of the stopper therein to prevent the exposure of any portions of the stopper.

Figure 5:
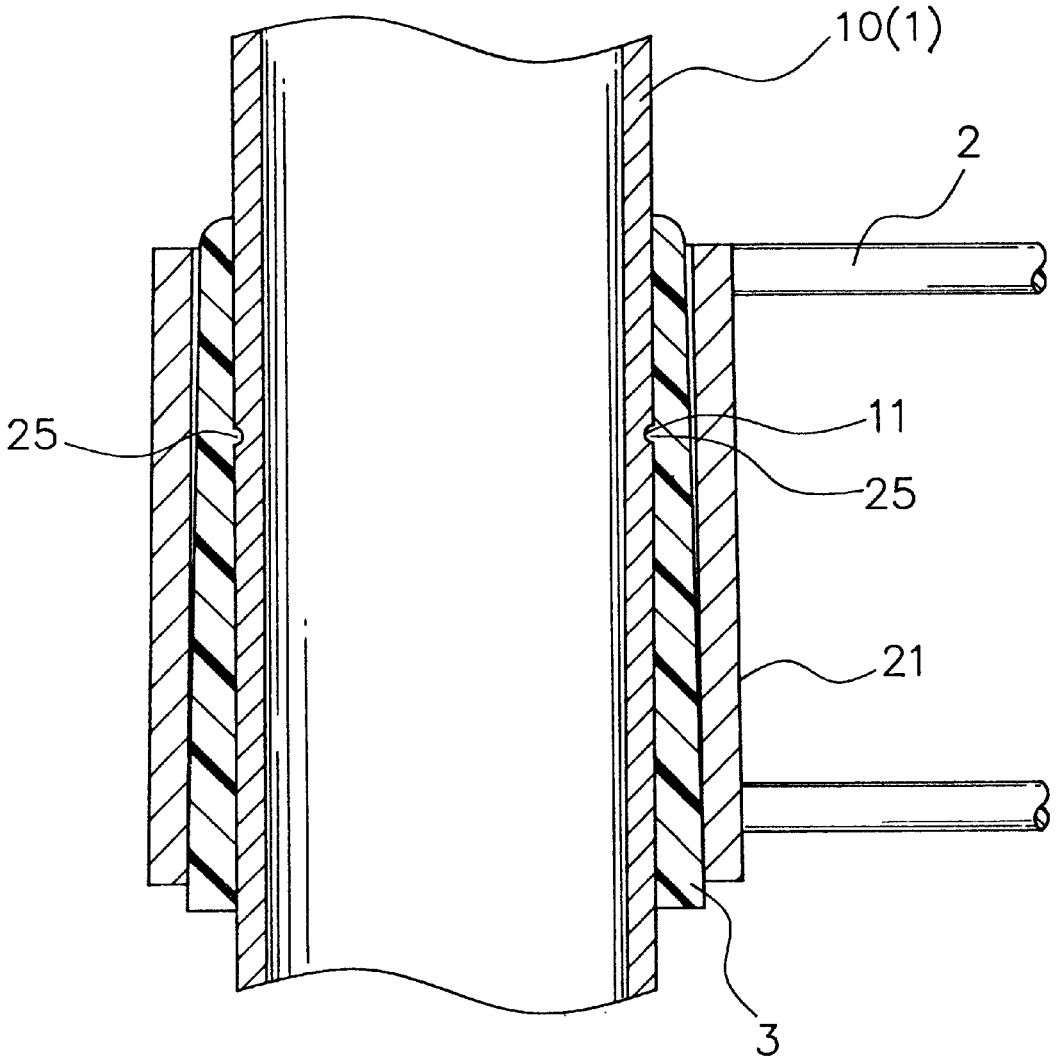
FIG. 5 is an enlarged cross section of an essential portion of the modular shelving unit of the first embodiment, illustrating a tubular member, a spacer and a socket in an attached state.

The spacer 3 has, as illustrated in FIGS. 4 and 5, a lengthwise axis and a hollowed body having a substantially frusto conical shape extending along the lengthwise axis, allowing a corresponding tubular member 10 to pass therethrough. The inner circumferential wall of the hollowed body of the spacer 3 forms an annular protrusion 25 having a semi-circular cross section on at least a portion thereof, which can be fitted into the annular groove 11. The spacer 3 can be held at a predetermined height of a corresponding upright post 1 by the engagement between the annular protrusion 25 and a selected annular groove 11. The spacer 3 can be optionally divided into two halves as illustrated in FIGS. 1 and 2, or formed by a plurality of pieces. In these separable arrangements, each of the halves or pieces is provided with a part of the annular protrusion 25, which arrangement may be convenient when the spacer 3 is attached on the post, but it is not necessary to configure the spacer 3 to be divided into two or more than two pieces.

The shelves 2 each are a wire-made plate with four corners respectively equipped with the sockets 21 of a cylindrical shape. The sockets 21 each define a through hole therein having a frusto conical shape in such a manner as to respectively fit around the spacers 3. The spacers 3 are inserted into the through holes of the sockets 21 for fixed engagement with the sockets 21, so that the shelves 2 are mounted on the posts 1 via the spacers 3. Thus, the modular shelving unit according to this embodiment is formed.

Figure 6:
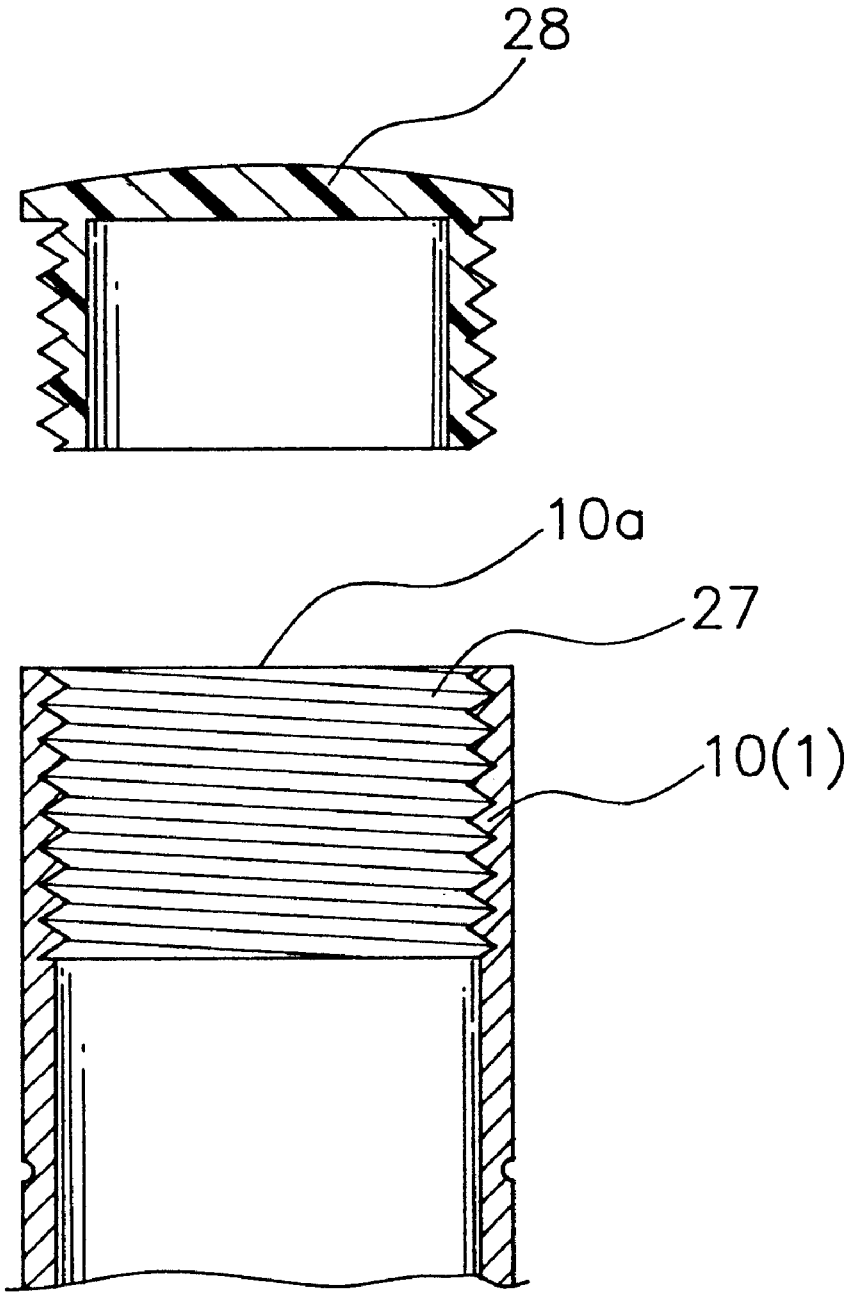
FIG. 6 is an exploded cross section of a cap and a tubular member with a partly omitted portion, illustrating an attaching mechanism for the cap and the tubular member.

The caps 28 are fitted on the upper end portions of the upright posts or the upper end portions 10*a* of the uppermost tubular members 10, as illustrated in FIG. 6. The caps 28 each have an outer circumferential wall defining an outwardly threaded portion adapted to be screwed into the inwardly threaded portion 27 of the upper end portion of each post, that is, each have the outwardly threaded portion having the same shape or pitch as that of the outwardly threaded portions of the interconnecting portion, so that the caps 28 can be inserted into the upper end portions and detachably attached thereto by screwing motion.

Figure 7:
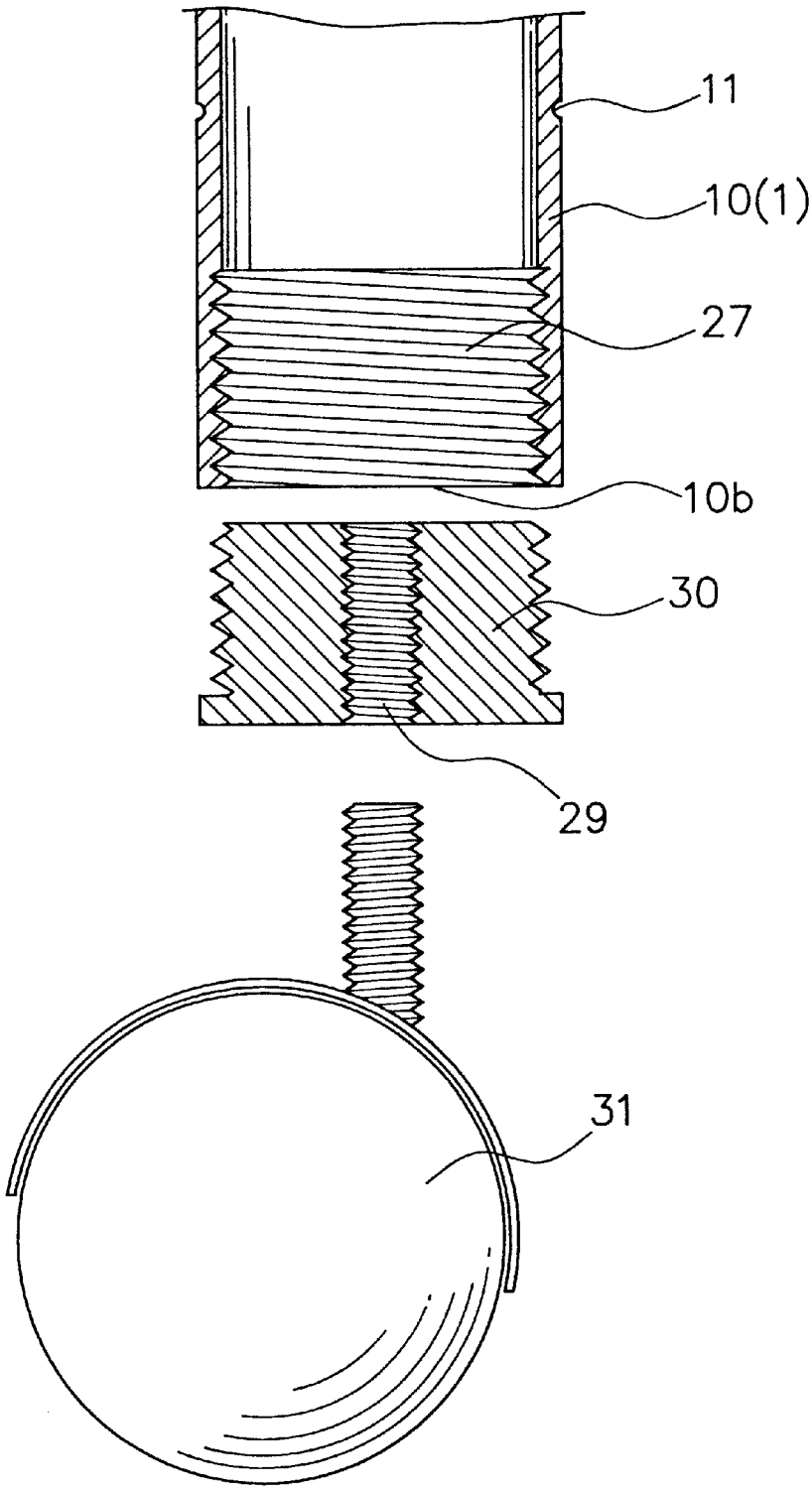
FIG. 7 is an exploded cross section with a partly omitted portion of an adjustable foot with a caster attachable to a tubular member.

On the other hand, the connectors 30 each acting as an adjustable foot for each post are respectively attached on the lower end portions of the posts or the lower end portions 10*b* of the lowermost tubular members 10, as illustrated in FIG. 7. The connectors 30 each have an outer circumferential wall defining an outwardly threaded portion adapted to be screwed into the inwardly threaded portion 27 of the lower end of each post, that is, each have the outwardly threaded portion having the same shape or pitch as that of the outwardly threaded portions of the interconnecting portion and the cap 28, so that the connectors 30 can be detachably attached on the posts 1 via the threaded engagement of the connectors.

In the center portion of each connector 30 are formed threaded portions 29, into which casters 31 are respectively screwed for fixed engagement with the connectors.

The modular shelving unit of the above arrangement produces the following effects.

The flange-like stopper 7 has substantially the same shape as that of the positioning groove 22 to be tightly fitted into the positioning groove 22, enabling the interconnecting member to be more rigidly integrated with the adjacent tubular members 10, and therefor forming remarkably sturdy posts. The thus formed modular shelving unit is tolerable against a relatively heavy load caused by objects placed on the shelves 2, and therefore is unlikely to have the shelves broken or deformed.

The stopper 7 of each interconnecting member prevents the interconnecting member from excessively entering into either one of the adjacent tubular members 10, thereby achieving easy interconnection of the adjacent tubular members 10, and therefore easy operation of assembling the modular shelving unit. The stopper 7 can be located at the middle portion of the interconnecting member 20 to allow the opposite end portions thereof to progress an equal distance from the corresponding edges of the adjacent tubular members. This arrangement equalizes interconnecting forces generated at the upper and lower interconnecting portions of the interconnecting member against the adjacent tubular members, thereby forming a well-balanced post without the occurrence of strength reduction in a local area of the post.

The modular shelving unit of the above arrangement having the arrangement, where the opposite end portions 10*a*, 10*b* of each tubular member 10 for forming each post 1 respectively form the inwardly threaded portions 27 having the same shape or pitch, and the interconnecting member 20, the caps 28 and the adjustable feet 30 respectively form the outwardly threaded portions adapted to be screwed into the inwardly threaded portions of the tubular members 10, enables the interconnecting members 20, the caps 28 and the connectors 30 to be screwed into any one of the end portions of all the tubular members 10.

Figure 8:
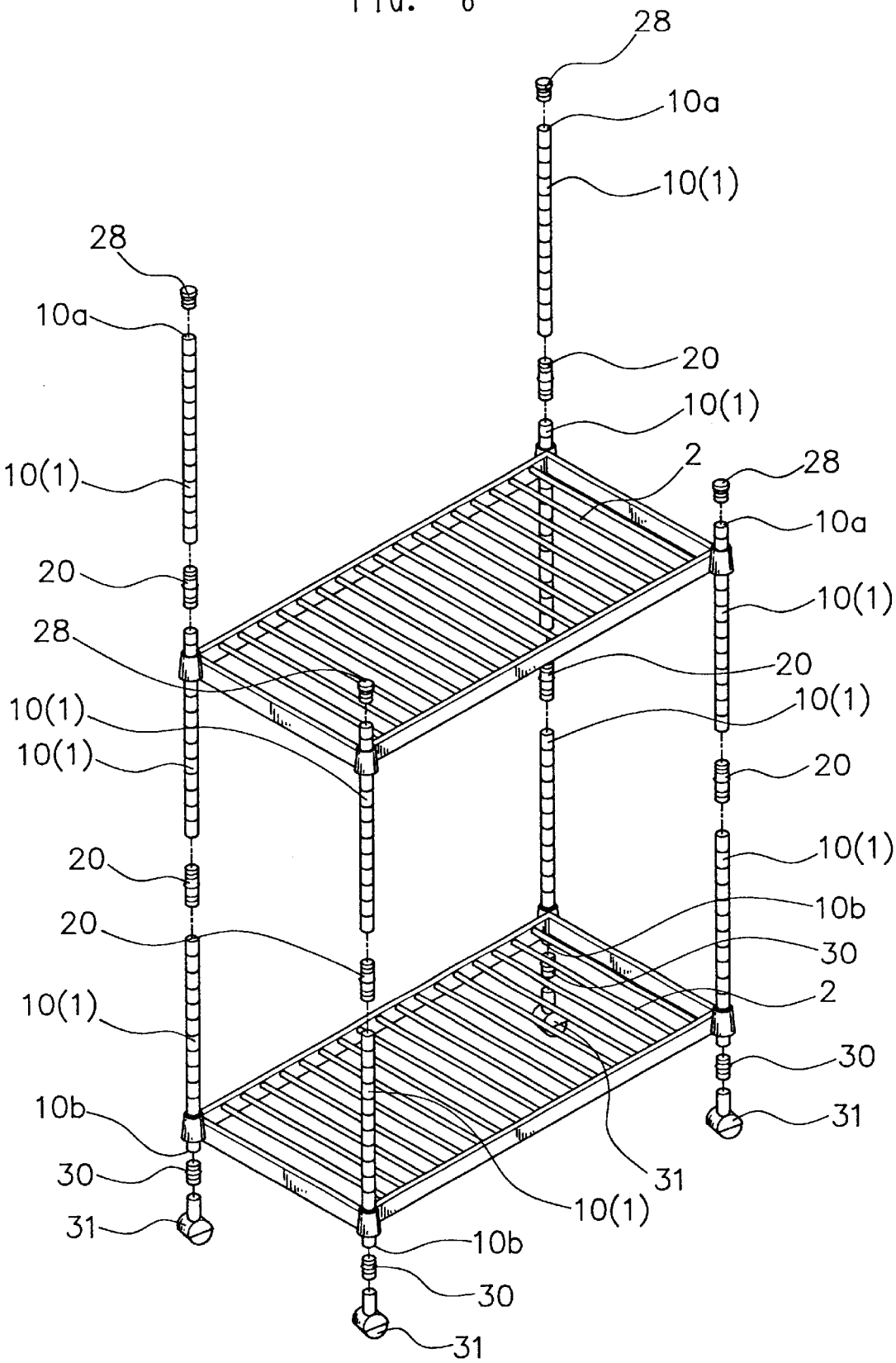
FIG. 8 is an exploded perspective view illustrating the modular shelving unit according to another embodiment of the present invention.

The modular shelving unit according to the present invention can have a varying formation. For example, the unit can have a formation with four posts formed by interconnecting three tubular members together via two interconnecting members, and the caps 28 and the adjustable feet 30 respectively attached on the upper and lower end portions 10*a* and 10*b* of these posts 1, as illustrated in FIG. 2. Alternatively, the unit may have a formation with four posts each formed by a single tubular member 10, and caps 28 and the connectors 30 respectively attached on the upper and lower end portions of these tubular members 10. FIG. 8 illustrates a different formation of the modular shelving unit which includes a first pair of posts each formed by three tubular members, and a second pair of posts each formed by two tubular members.

Thus, the modular shelving unit can have a varying formation by varying the number of the tubular members 10 to be interconnected for each post by the user without the limitation of cap or adjustable foot connectable portions for each post. This provides higher flexibility in combining various parts together, and easy use as compared with conventional modular shelving units.

It is to be noted that the modular shelving unit of the present invention is not necessarily limited to the above embodiments, and various modifications to the modular shelving unit may be made, although the modular shelving unit of the above embodiment produces the desirable effects as mentioned above.

Figure 9:
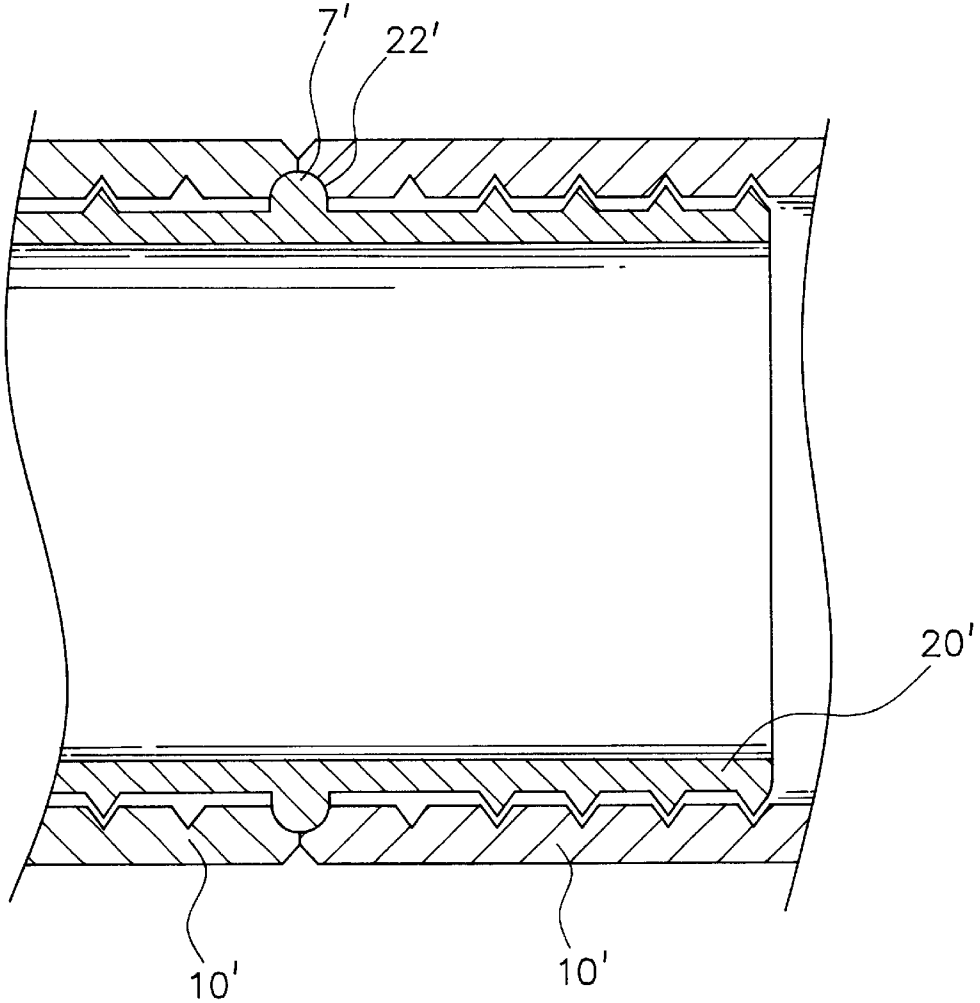
FIG. 9 is an enlarged cross section of the interconnecting mechanism of the tubular members with a partly omitted portion according to another embodiment of the present invention.

Specifically, the stopper 7' and the positioning groove 22' of the above embodiment having a substantially triangular cross section may have a varying cross sectional configuration, provided that they can be engaged with each other. For example, they may be of a semi-circular cross section, as illustrated in FIG. 9, which has no sharp edges, thereby achieving easy handling of the interconnecting member 20' without special care for hands of the user, etc.

The assembled annular groove 14 which the abutting edges of the tubular members together form in the outer circumferential walls may have a V-shaped cross section, and the annular protrusion 25 formed in the inner circumferential wall of the spacer 3 may correspondingly have a triangular or inverted V-shaped cross section to be engageable with the positioning groove 22.

Figure 10:
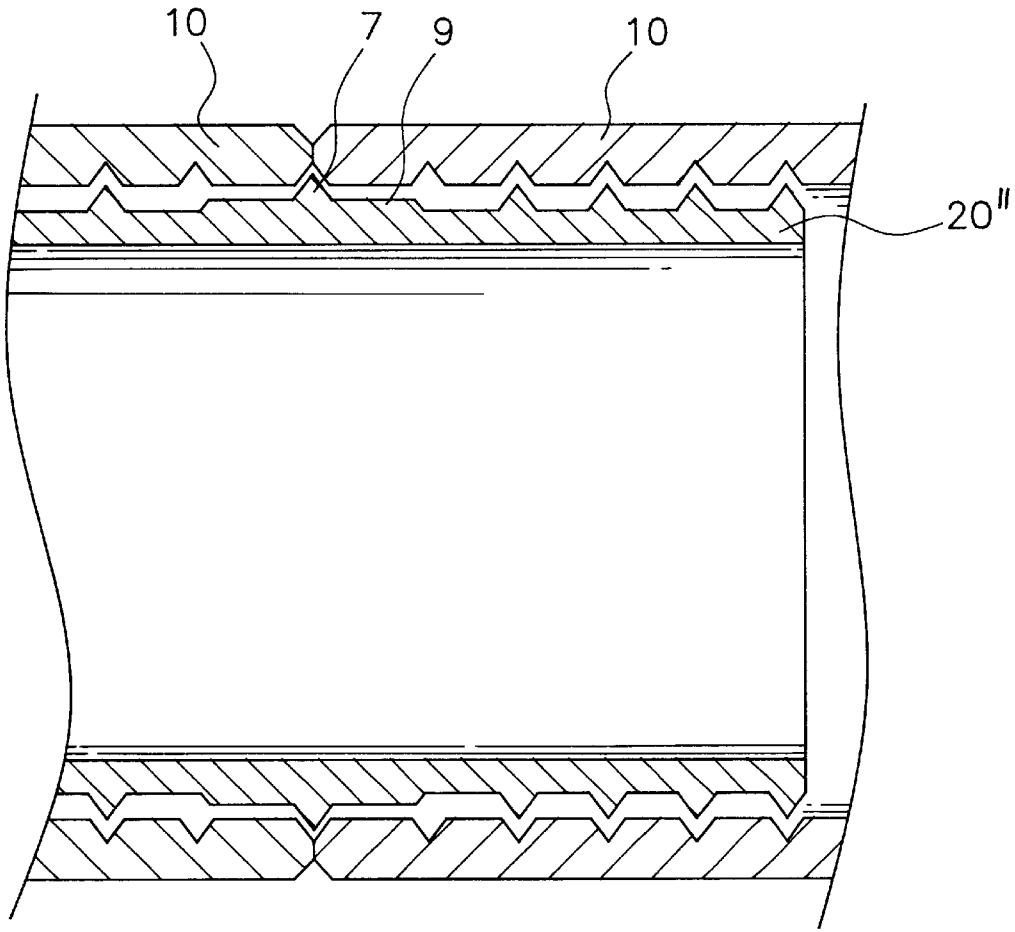
FIG. 10 is an enlarged cross section of the interconnecting mechanism of the tubular members with a partly omitted portion according to a further embodiment of the present invention.

In the above embodiment, the annular recesses 23 are formed in the entire surfaces of the outer circumferential wall of the interconnecting member between the stopper 7 and the outwardly threaded portions 6. This arrangement may also be varied. For example, as shown in FIG. 10, the interconnecting member 20" may have a bulge 9 having an outer diameter being equal to the inner diameter of the tubular members 10 and being provided in the middle portion of the interconnecting member 20", and the stopper 7 being provided in a substantially middle portion of the bulge 9. The bulge 9 enables the interconnecting member 20" to more fittingly contact the inner circumferential walls of tubular members 10. Whereby, more accurate alignment of the adjacent tubular members is accomplished, as producing the abovementioned effect by the stopper 7. This accurate aligning of the adjacent tubular members 10 can prevent the load from concentrating into a particular region so as to provide a more durable shelving unit.

Figure 11:
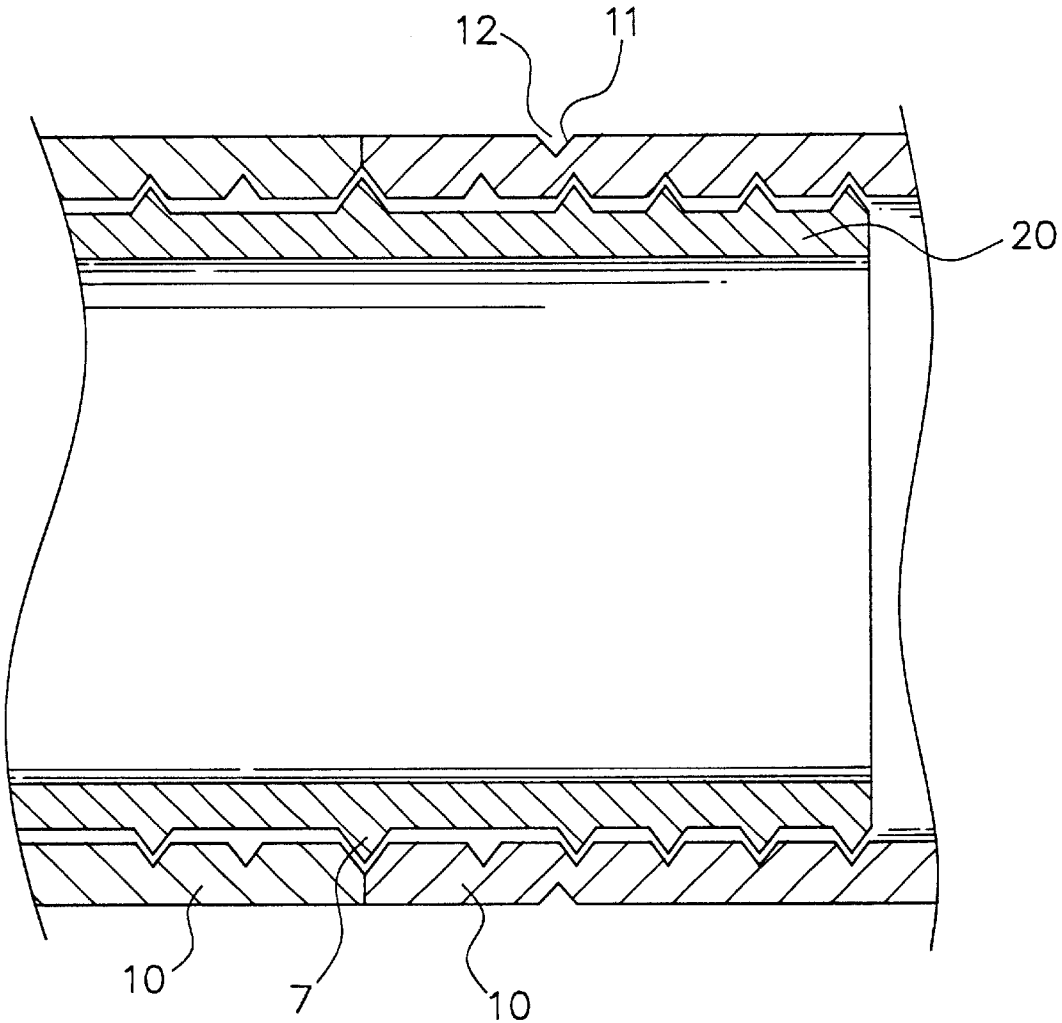
FIG. 11 is an enlarged cross section of the interconnecting mechanism of the tubular members with a partly omitted portion according to still another embodiment of the present invention.

It is not necessary to form the assembled annular groove 14 by the abutting edges of the adjacent tubular members 10. Instead, an annular groove 11 may be formed at a position 12 of the outer wall apart from the edge of the tubular member, as illustrated in FIG. 11.

Figure 12:
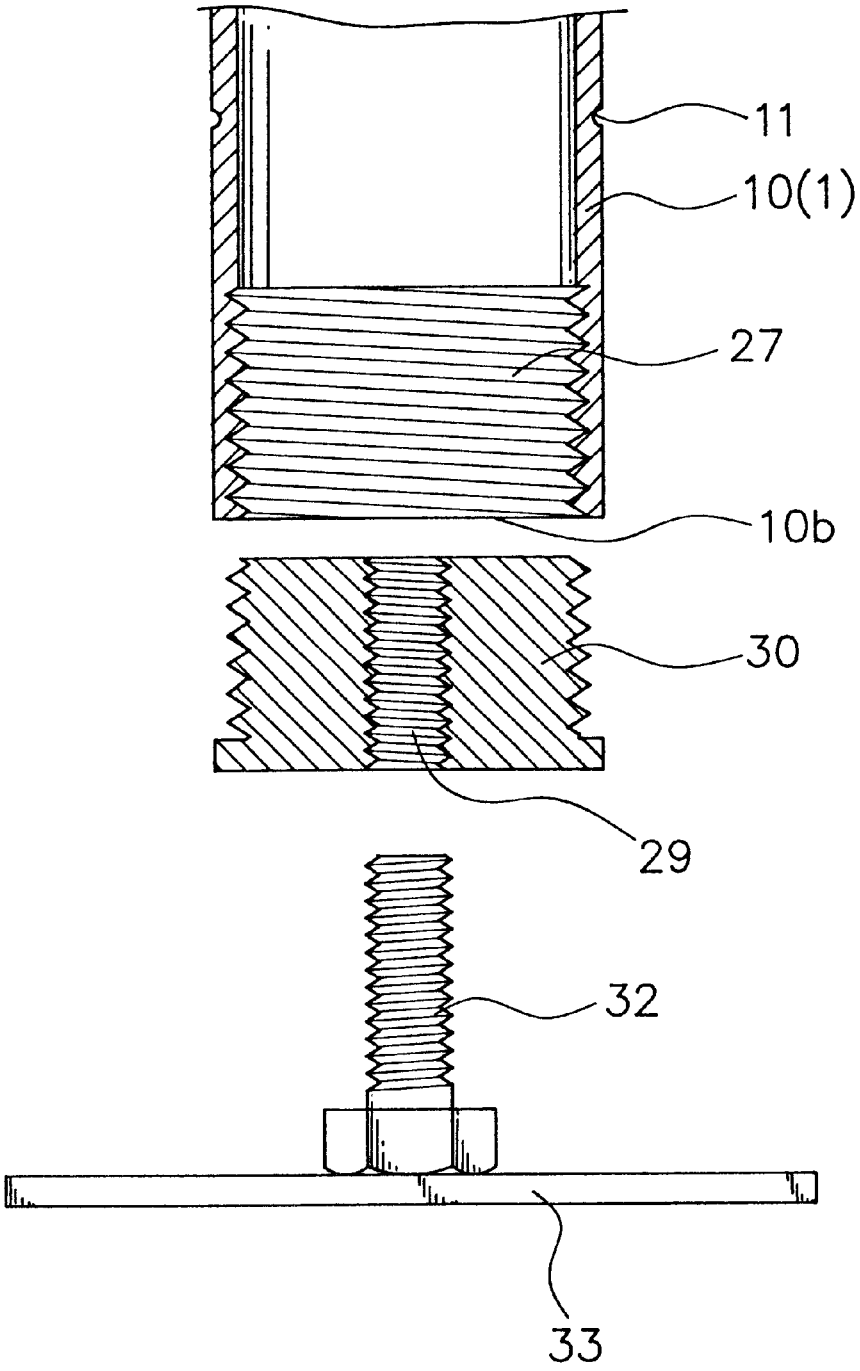
FIG. 12 is an exploded view of an adjustable foot and a tubular member with a partly omitted portion and partly cross section, illustrating an attaching mechanism for the adjustable foot and the tubular member.

The members attachable to the connectors 30 are not limited to the casters 31. For example, members each having a pad 33 and a threaded portion protruding from the pad for threaded engagement with a corresponding connector 30 may be attached to the connectors 30, as illustrated in FIG. 12.

Figure 13:
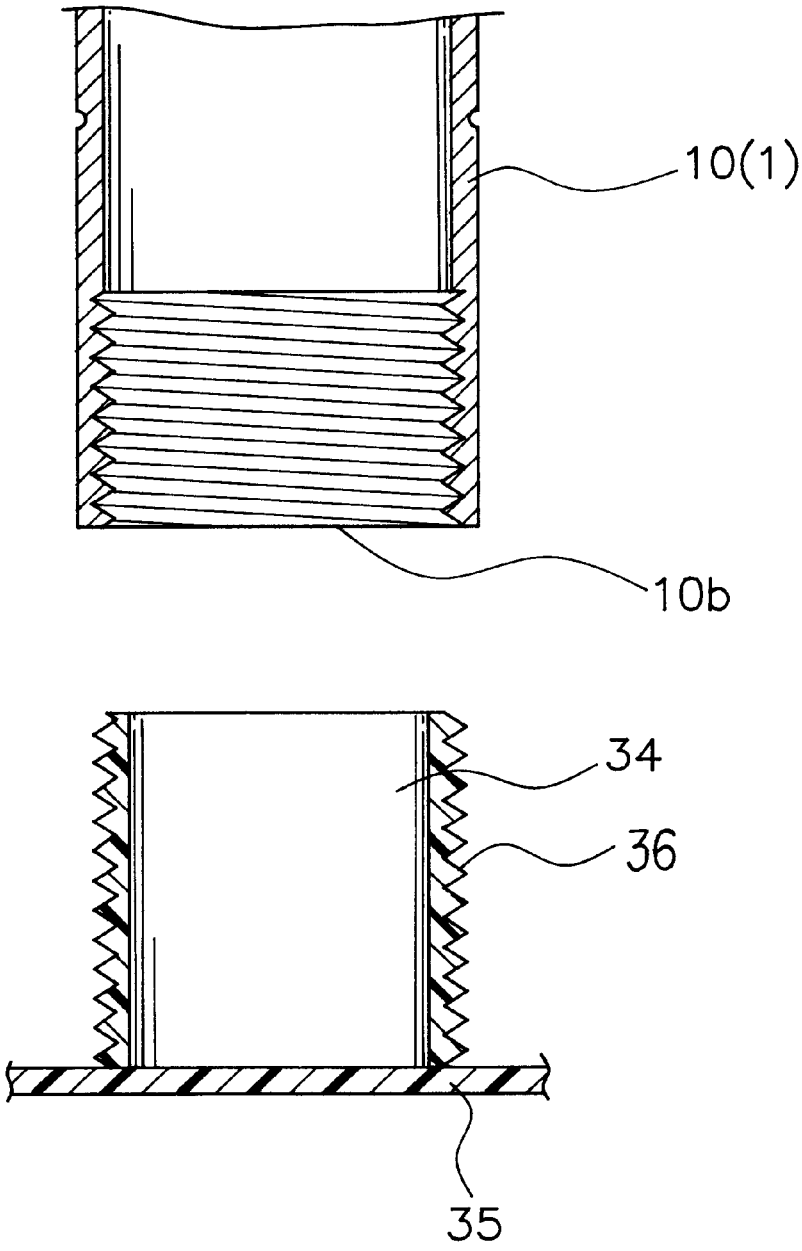
FIG. 13 is an exploded cross section illustrating an attaching mechanism for an adjustable foot and a tubular member with a partly omitted portion according to another embodiment of the present invention.
Figure 14:
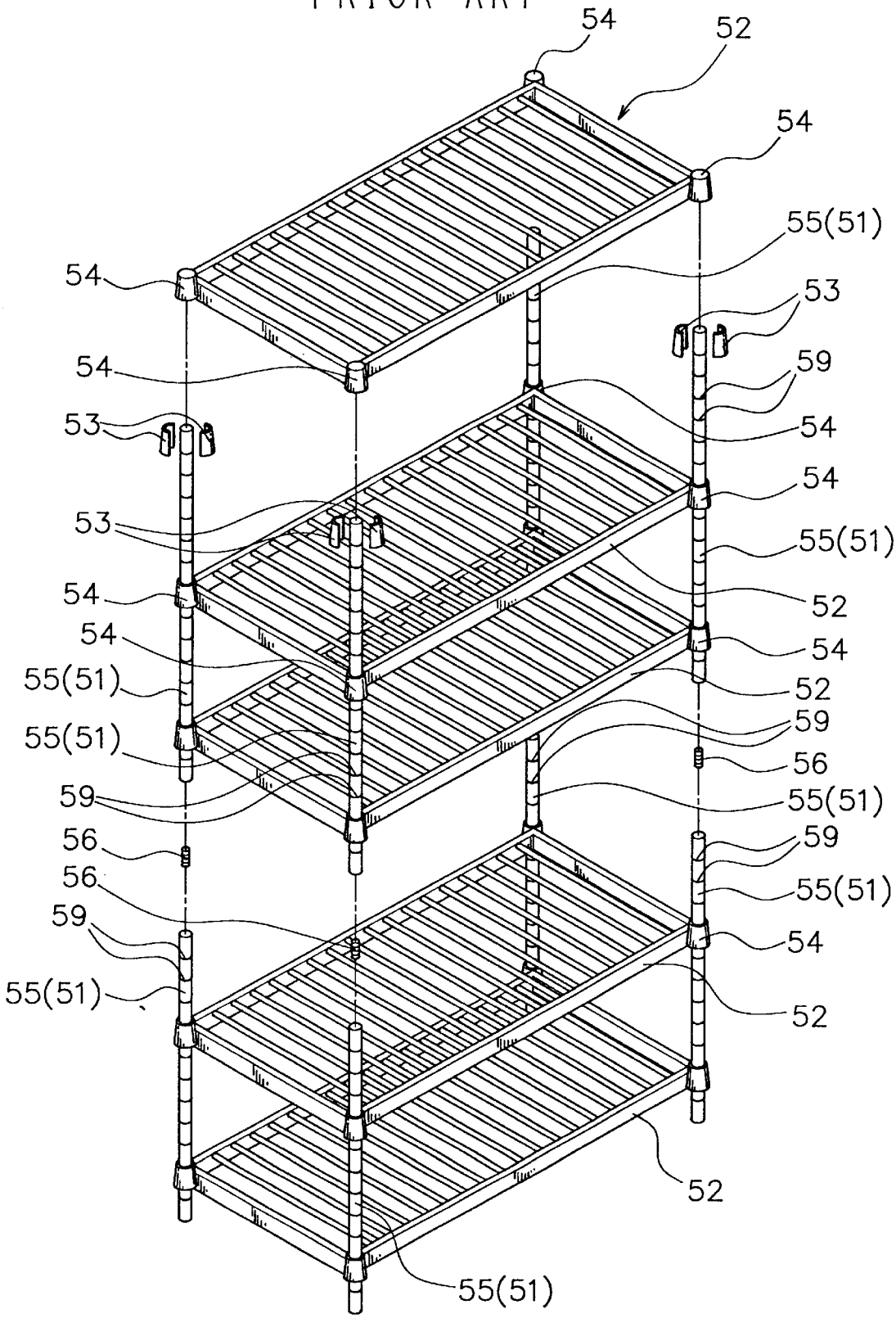
FIG. 14 PRIOR ART
FIG. 14 is a perspective view of a conventional modular shelving unit.
Figure 15B:
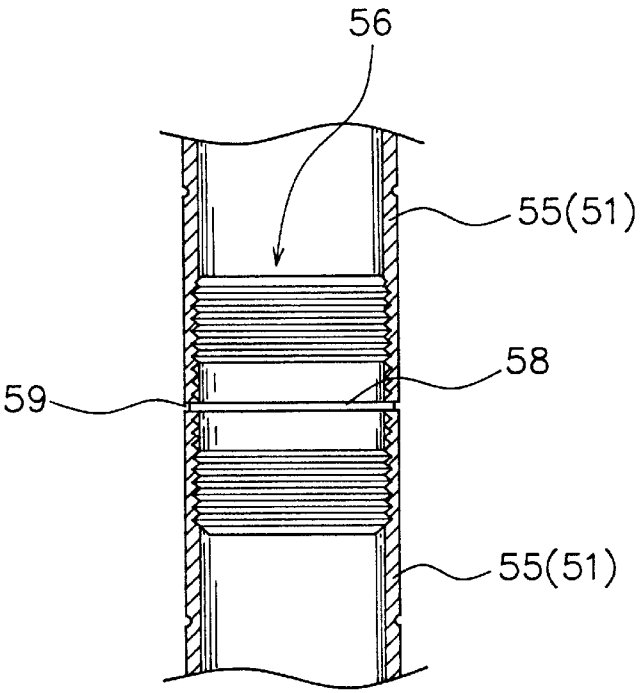
FIG. 15(b) PRIOR ART
FIG. 15(*a*) is an enlarged view of tubular members with a partly cross section in an attachable state with a conventional interconnection mechanism.
Figure 15A:
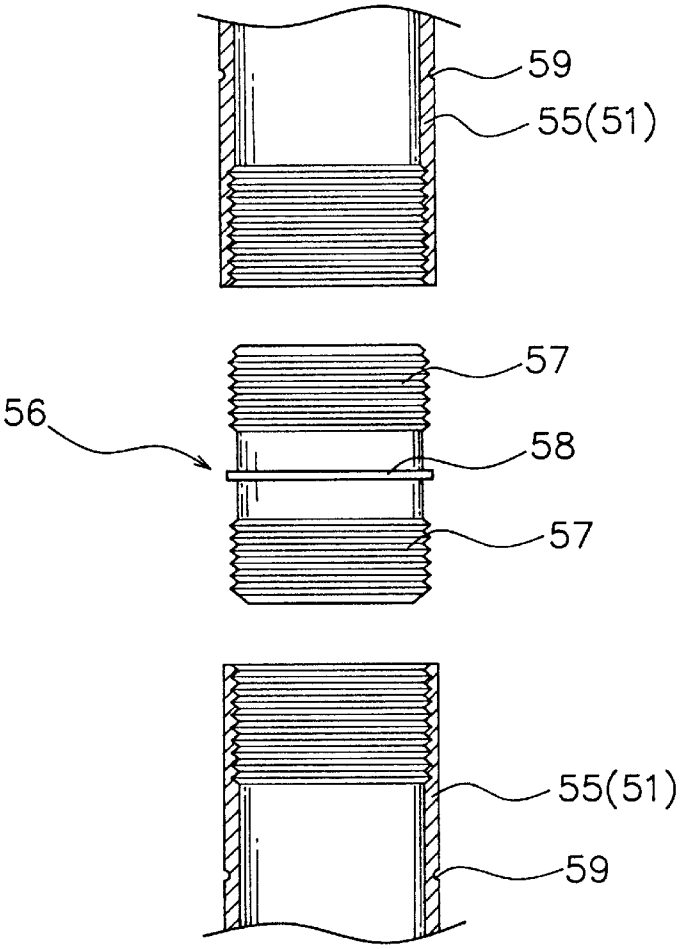
FIG. 15(a) PRIOR ART
Figure 16:
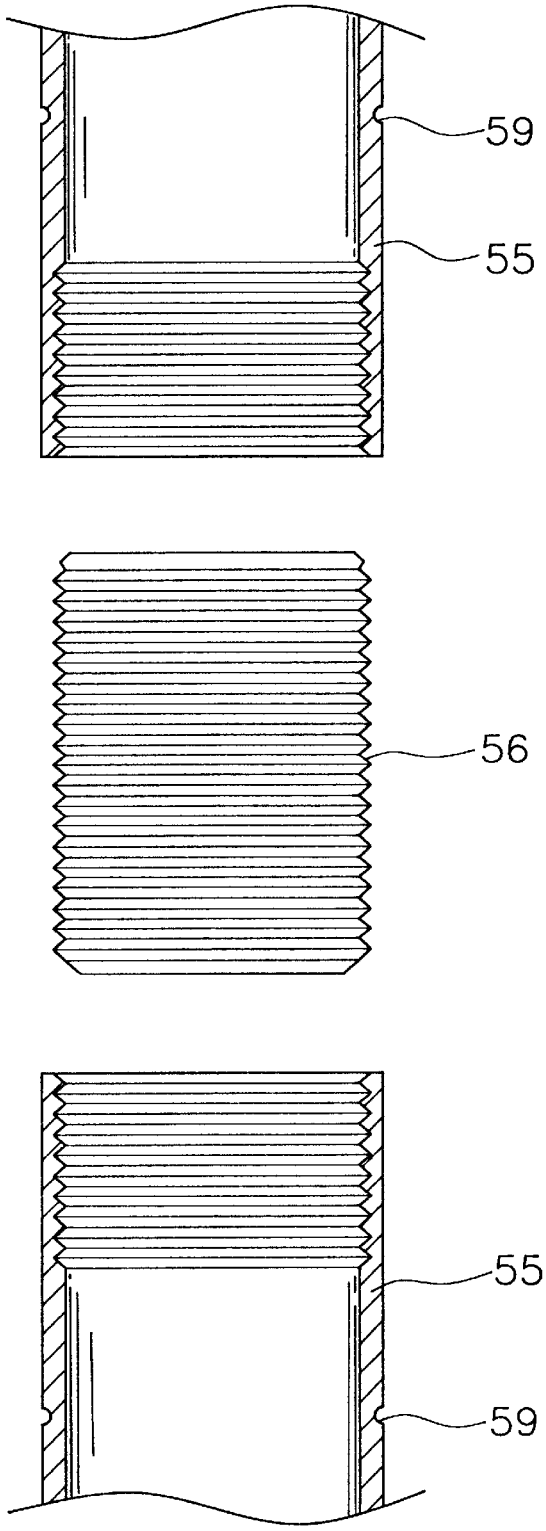
FIG. 16 PRIOR ART
FIG. 16 is an enlarged view with a partly cross section of conventional tubular members and an interconnecting member.
Figure 17:
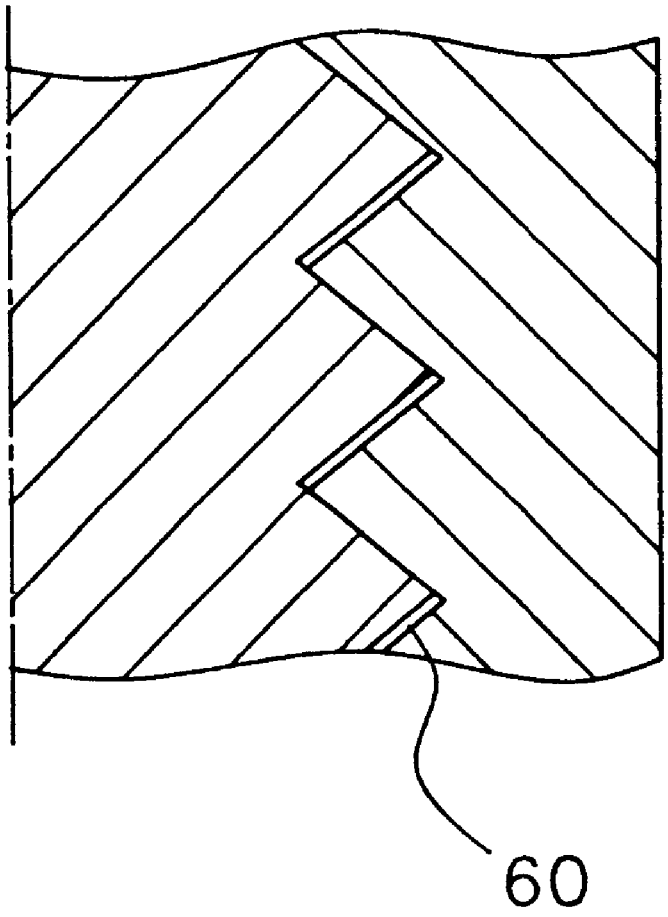
FIG. 17 PRIOR ART
FIG. 17 is an enlarged cross section illustrating an improper positioning of the threaded portions of the tubular member with regard to the interconnecting member.
Figure 18:
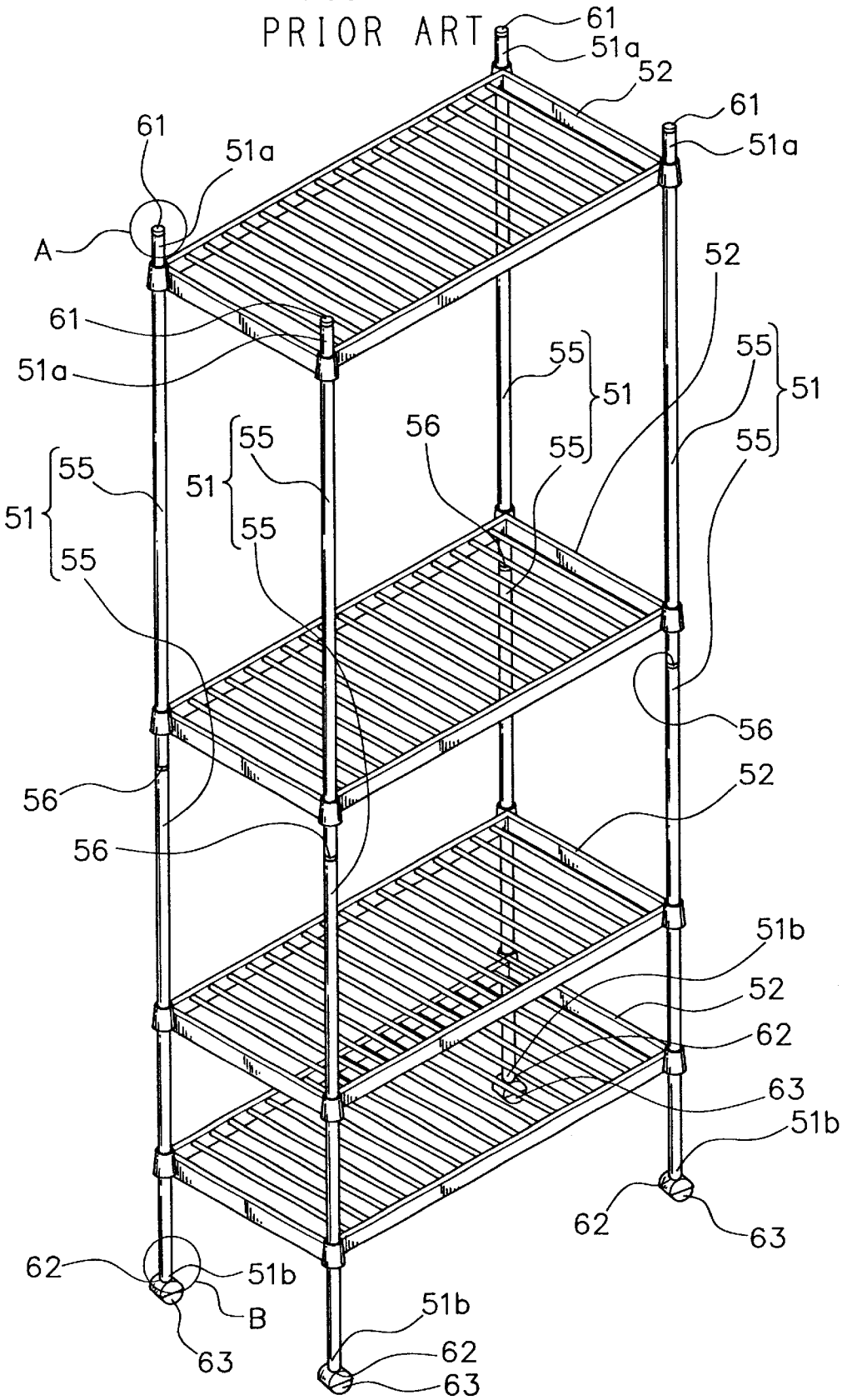
FIG. 18 PRIOR ART
FIG. 18 is a perspective view of the conventional modular shelving unit with the caps and the adjustable post receiving means.
Figure 19B:
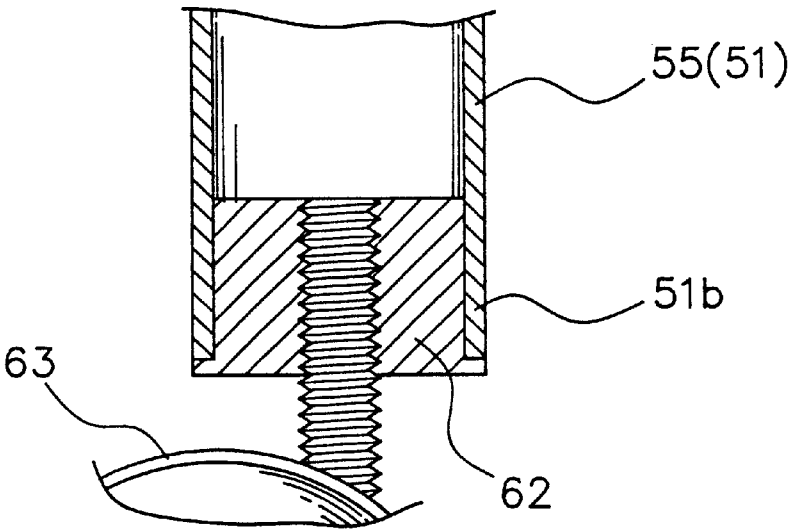
FIG. 19(b) PRIOR ART
FIG. 19(*a*) is a cross section of a portion of the modular shelving unit defined by the circle A in FIG. 18.
Figure 19A:
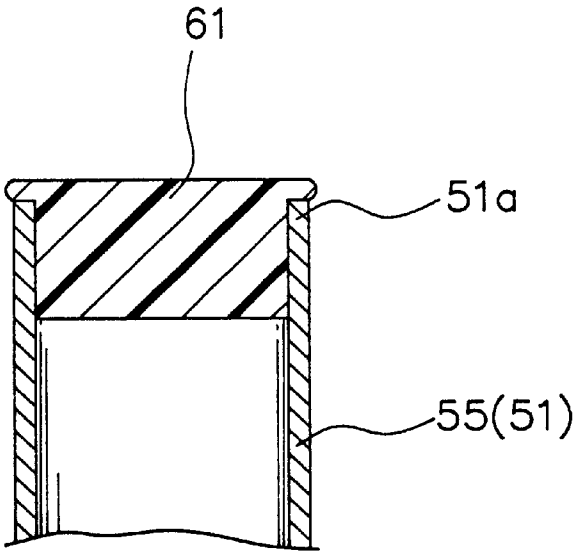
FIG. 19(a) PRIOR ART

Instead of the connectors 30 acting as the adjustable feet, threaded members 34 each having a pad 35 secured thereto may be detachably attached to the end portions of the tubular members 10*a* or 10*b*, as shown, for example, in FIG. 13. As another example, the casters 31 may be directly attached to the end portions of the tubular members 10*a* or 10*b* in a detachable manner to act as the adjustable feet.

It is not meant that the opposite end portions 10*a*, 10*b* of each tubular member have a perfectly identical shape, although they are characterized as receiving any members, including the interconnecting member 20, cap 28 and adjustable foot 36. It is essential to employ any shape for these members, provided that they can be detachably attached to each other in a relatively easy manner.

The attaching means of the tubular members, the interconnecting members, the caps and the adjustable feet 36 is not necessarily limited to threaded engagement. Instead, they may be snap-fitted to each other, for example via annular recesses formed in the inner circumferential wall of the opposite end portions 10*a*, 10*b* of each tubular member and annular protrusions in the outer circumferential walls of the interconnecting members 20, caps 28 and adjustable feet 36, or vise versa.

It is not necessary that the modular shelving unit of the present invention includes four posts 1. It is possible to select any number of the posts, provided that they can receive and support at least one shelf 2 in position. Specifically, at least three spaced posts would be sufficient for this function.

The engagements between the posts 1 and the spacers 3 are accomplished by the engagement between the annular grooves 11 formed in the outer circumferential walls of the posts 1 and the annular protrusions 25 formed on the inner circumferential walls of the spacers 3. Alternatively, these engagements may be made by a sticky material instead of the annular protrusions 25 provided on the inner circumferential walls of the spacers 3. In this arrangement, the annular grooves 11 of the posts 1 may be omitted. This arrangement is also within the scope of the present invention. With this arrangement, it is possible to retain the spacers 3 at any heights of the posts, thereby providing for improved flexibility in adjusting the height of the shelf 2.

This specification is by no means intended to restrict the present invention to the preferred embodiments set forth therein. Various modifications to the modular shelving unit, as described herein, may be made by those skilled in the art without departing from the spirit and scope of the present invention as defined in the appended claims.

What is claimed is:

1. A modular shelving unit comprising:

at least three upright posts being spaced apart from each other;

at least one shelf supported between said at least three upright posts;

spacers respectively attached on said at least three posts;

sockets provided on said at least one shelf for being respectively fitted around the spacers in such a manner as to support said at least one shelf between said at least three posts;

at least one of said at least three posts including at least two tubular members and at least one interconnecting member for detachably interconnecting adjacent tubular members of said at least two tubular members together via attaching means;

said at least two tubular members each having opposite edges and an inner circumferential wall defining annular inclined surfaces, said annular inclined surfaces being radially and outwardly inclined, as they advance to adjacent edges of said opposite edges; and said at least one interconnecting member having an outer circumferential wall with opposite end portions and a flange-like stopper radially and outwardly projecting from said outer circumferential wall, wherein said adjacent tubular members of said at least two tubular members are interconnected to said at least one interconnecting member via said attaching means with mutually facing edges of the adjacent tubular members abutting each other, said annular inclined surfaces of the adjacent tubular members together form a positioning groove continuously extending along the abutting edges of the adjacent tubular members, and said flange-like stopper is fitted into said positioning groove with the flange-like stopper resting on the inclined surfaces of the positioning groove.

2. A modular shelving unit as set forth in claim 1, wherein said at least three posts each include said at least two tubular members and said at least one interconnecting member.

3. A modular shelving unit as set forth in claim 1, wherein said attaching means includes an inwardly threaded portion formed on the inner circumferential wall of each of said at least two tubular members and outwardly threaded portions respectively formed on the opposite end portions of said at least one interconnecting member for being respectively screwed into the inwardly threaded portions of the adjacent tubular members, and said flange-like stopper is formed between said outwardly threaded portions of said at least one interconnecting member.

4. A modular shelving unit as set forth in claim 3, wherein said at least one interconnecting member forms annular recesses in the outer circumferential wall thereof between the flange-like stopper and the outwardly threaded portions.

5. A modular shelving unit as set forth in claim 3, which further comprises caps and adjustable feet which respectively have outwardly threaded portions provided on the outer circumferential walls thereof for being respectively screwed into the inwardly threaded portions of said tubular members, so that said at least three posts can be provided with said caps and said adjustable feet.

6. A modular shelving unit as set forth in claim 1, wherein said at least three posts each are provided on the outer circumferential wall with axially spaced annular grooves, said spacers each include a plurality of parts respectively having inner circumferential walls respectively defining protrusions which together form an annular protrusion for being fitted into a corresponding one of said axially spaced annular grooves of each of said at least three posts when said plurality of parts are interconnected together, thereby allowing said spacers to be respectively and detachably attached to said at least three posts, and said at least two tubular members each have an outer circumferential will defining annular inclined surfaces radially and inwardly inclined as they advance to adjacent edges of said opposite edges of each of said at least two tubular member, wherein said annular inclined surfaces of adjacent tubular members of said at least two tubular members together form an assembled annular groove continuously extending along the abutting edges of the adjacent tubular members so as to receive said annular protrusion of a corresponding one of the spacers.

7. A modular shelving unit comprising:

at least three upright posts being spaced apart from each other;

at least one shelf supported between said plurality of upright posts;

caps respectively attached on upper end portions of said at least three upright posts;

adjustable feet respectively attached on lower end portions of said at least three upright posts; and at least one of said at least three upright posts including at least two tubular members and at least one interconnecting member for interconnecting adjacent tubular members of said at least two tubular members together, said at least two tubular members each having opposite end portions, to which each of said caps and each of said adjustable feet can be respectively and detachably attached.

8. A modular shelving unit as set forth in claim 7, wherein said at least three posts each include said at least two tubular members and said at least one interconnecting member.

9. A modular shelving unit as set forth in claim 7, wherein said opposite end portions of said at least two tubular members respectively define inwardly threaded portions, and said interconnecting member, said caps and said adjustable feet respectively have outwardly threaded portions for being respectively screwed into said inwardly threaded portions of said at least two tubular members.

10. A modular shelving unit comprising:

at least three upright posts being spaced apart from each other;

at least one shelf supported between said at least three upright posts;

spacers respectively attached on said at least three posts;

sockets provided on said at least one shelf for being respectively fitted around the spacers in such a manner as to support said at least one shelf between said at least three posts;

said at least three posts each including at least two tubular members and at least one interconnecting member for interconnecting adjacent tubular members of said at least two tubular members together;

said at least two tubular members each having opposite edges, and an inner circumferential wall defining an inwardly threaded portion and annular inclined surfaces, said annular inclined surfaces being radially and outwardly inclined as they advance to adjacent edges of said opposite edges of each of said at least two tubular members; and said at least one interconnecting member having an outer circumferential wall with opposite end portions respectively defining outwardly threaded portions for being respectively screwed into the inwardly threaded portions of the adjacent tubular members of said at least two tubular members so as to interconnect said adjacent tubular members together, with mutually facing edges of the adjacent tubular members abutting each other, a flange-like stopper radially and outwardly projecting from said outer circumferential wall between said outwardly threaded portions, and annular recesses formed between said flange-like stopper and said outwardly threaded portions, wherein said annular inclined surfaces of the adjacent tubular members together form a positioning groove continuously extending along the abutting edges of the adjacent tubular members, and the flange-like stopper of the interconnecting member is fitted into said positioning groove with the flange-like stopper resting on the inclined surfaces of the positioning groove.

* * * * *